US008536794B2

(12) United States Patent
Melanson et al.

(10) Patent No.: US 8,536,794 B2
(45) Date of Patent: Sep. 17, 2013

(54) LIGHTING SYSTEM WITH LIGHTING DIMMER OUTPUT MAPPING

(75) Inventors: John L. Melanson, Austin, TX (US); John J. Paulos, Austin, TX (US)

(73) Assignee: Cirrus Logic, Inc., Austin, TX (US)

( * ) Notice: Subject to any disclaimer, the term of this patent is extended or adjusted under 35 U.S.C. 154(b) by 366 days.

(21) Appl. No.: 12/474,714

(22) Filed: May 29, 2009

(65) Prior Publication Data

US 2010/0060202 A1 Mar. 11, 2010

Related U.S. Application Data

(62) Division of application No. 11/695,024, filed on Apr. 1, 2007, now Pat. No. 7,667,408.

(60) Provisional application No. 60/894,295, filed on Mar. 12, 2007.

(51) Int. Cl.
*H05B 37/02* (2006.01)

(52) U.S. Cl.
USPC ..... 315/291; 315/307

(58) Field of Classification Search
USPC ..... 315/200 R, 246, 247, 291, 307, DIG. 4
See application file for complete search history.

(56) References Cited

U.S. PATENT DOCUMENTS

| | | | |
|---|---|---|---|
| 3,316,495 | A | 4/1967 | Sherer |
| 3,423,689 | A | 1/1969 | Miller et al. |
| 3,586,988 | A | 6/1971 | Weekes |
| 3,725,804 | A | 4/1973 | Langan |
| 3,790,878 | A | 2/1974 | Brokaw |
| 3,881,167 | A | 4/1975 | Pelton et al. |
| 4,075,701 | A | 2/1978 | Hofmann |
| 4,334,250 | A | 6/1982 | Theus |
| 4,409,476 | A | 10/1983 | Lofgren et al. |

(Continued)

FOREIGN PATENT DOCUMENTS

| | | |
|---|---|---|
| DE | 19713814 | 10/1998 |
| EP | 0585789 A1 | 3/1994 |

(Continued)

OTHER PUBLICATIONS

ST Datasheet L6562, Transition-Mode PFC Controller, 2005, STMicroelectronics, Geneva, Switzerland.

(Continued)

*Primary Examiner* — Jimmy Vu
(74) *Attorney, Agent, or Firm* — Terrile, Cannatti, Chambers & Holland, LLP; Kent B. Chambers

(57) ABSTRACT

A system and method map dimming levels of a lighting dimmer to light source control signals using a predetermined lighting output function. The dimmer generates a dimmer output signal value. At any particular period of time, the dimmer output signal value represents one of multiple dimming levels. In at least one embodiment, the lighting output function maps the dimmer output signal value to a dimming value different than the dimming level represented by the dimmer output signal value. The lighting output function converts a dimmer output signal values corresponding to measured light levels to perception based light levels. A light source driver operates a light source in accordance with the predetermined lighting output function. The system and method can include a filter to modify at least a set of the dimmer output signal values prior to mapping the dimmer output signal values to a new dimming level.

16 Claims, 10 Drawing Sheets

(56) References Cited

U.S. PATENT DOCUMENTS 4,414,493 A 11/1983 Henrich
4,476,706 A 10/1984 Hadden et al.
4,523,128 A 6/1985 Stamm
4,677,366 A 6/1987 Wilkinson et al.
4,683,529 A 7/1987 Bucher
4,700,188 A 10/1987 James
4,737,658 A 4/1988 Kronmuller et al.
4,797,633 A 1/1989 Humphrey
4,937,728 A 6/1990 Leonardi
4,940,929 A 7/1990 Williams
4,973,919 A 11/1990 Allfather
4,979,087 A 12/1990 Sellwood et al.
4,980,898 A 12/1990 Silvian
4,992,919 A 2/1991 Lee et al.
4,994,952 A 2/1991 Silva et al.
5,001,620 A 3/1991 Smith
5,055,746 A 10/1991 Hu et al.
5,109,185 A 4/1992 Ball
5,121,079 A 6/1992 Dargatz
5,206,540 A 4/1993 de Sa e Silva et al.
5,264,780 A 11/1993 Bruer et al.
5,278,490 A 1/1994 Smedley
5,323,157 A 6/1994 Ledzius et al.
5,383,109 A 1/1995 Maksimovic et al.
5,424,932 A 6/1995 Inou et al.
5,479,333 A 12/1995 McCambridge et al.
5,565,761 A 10/1996 Hwang
5,589,759 A 12/1996 Borgato et al.
5,638,265 A 6/1997 Gabor
5,691,890 A 11/1997 Hyde
5,747,977 A 5/1998 Hwang
5,757,635 A 5/1998 Seong
5,764,039 A 6/1998 Choi et al.
5,768,111 A 6/1998 Zaitsu
5,781,040 A 7/1998 Myers
5,798,635 A 8/1998 Hwang et al.
5,900,683 A 5/1999 Rinehart et al.
5,912,812 A 6/1999 Moriarty, Jr.
5,929,400 A 7/1999 Colby et al.
5,946,202 A 8/1999 Balogh
5,946,206 A 8/1999 Shimizu et al.
5,952,849 A 9/1999 Haigh
5,960,207 A 9/1999 Brown
5,962,989 A 10/1999 Baker
5,963,086 A 10/1999 Hall
5,966,297 A 10/1999 Minegishi
6,016,038 A 1/2000 Mueller et al.
6,072,969 A 6/2000 Yokomori et al.
6,083,276 A 7/2000 Davidson et al.
6,084,450 A 7/2000 Smith et al.
6,091,233 A 7/2000 Hwang
6,125,046 A 9/2000 Jang et al.
6,150,774 A 11/2000 Mueller et al.
6,181,114 B1 1/2001 Hemena et al.
6,211,626 B1 4/2001 Lys et al.
6,211,627 B1 4/2001 Callahan
6,229,292 B1 5/2001 Redl et al.
6,246,183 B1 6/2001 Buonavita
6,300,723 B1 10/2001 Wang et al.
6,304,473 B1 10/2001 Telefus et al.
6,343,026 B1 1/2002 Perry
6,344,811 B1 2/2002 Melanson
6,369,525 B1 4/2002 Chang et al.
6,385,063 B1 5/2002 Sadek et al.
6,407,514 B1 6/2002 Glaser et al.
6,407,515 B1 6/2002 Hesler
6,407,691 B1 6/2002 Yu
6,441,558 B1 8/2002 Muthu et al.
6,452,521 B1 9/2002 Wang
6,469,484 B2 10/2002 L'Hermite et al.
6,495,964 B1 12/2002 Muthu et al.
6,509,913 B2 1/2003 Martin, Jr. et al.
6,531,854 B2 3/2003 Hwang
6,583,550 B2 6/2003 Iwasa et al.
6,628,106 B1 9/2003 Batarseh et al.
6,636,003 B2 10/2003 Rahm et al.
6,646,848 B2 11/2003 Yoshida et al.
6,657,417 B1 12/2003 Hwang
6,688,753 B2 2/2004 Calon et al.
6,713,974 B2 3/2004 Patchornik et al.
6,724,174 B1 4/2004 Esteves et al.
6,727,832 B1 4/2004 Melanson
6,737,845 B2 5/2004 Hwang
6,741,123 B1 5/2004 Andersen et al.
6,753,661 B2 6/2004 Muthu et al.
6,756,772 B2 6/2004 McGinnis
6,768,655 B1 7/2004 Yang et al.
6,781,351 B2 8/2004 Mednik et al.
6,788,011 B2 9/2004 Mueller et al.
6,806,659 B1 10/2004 Mueller et al.
6,839,247 B1 1/2005 Yang
6,860,628 B2 3/2005 Robertson et al.
6,870,325 B2 3/2005 Bushell et al.
6,873,065 B2 3/2005 Haigh et al.
6,882,552 B2 4/2005 Telefus et al.
6,888,322 B2 5/2005 Dowling et al.
6,894,471 B2 5/2005 Corva et al.
6,933,706 B2 8/2005 Shih
6,940,733 B2 9/2005 Schie et al.
6,944,034 B1 9/2005 Shteynberg et al.
6,956,750 B1 10/2005 Eason et al.
6,958,920 B2 10/2005 Mednik et al.
6,963,496 B2 11/2005 Bimbaud
6,967,448 B2 11/2005 Morgan et al.
6,975,079 B2 12/2005 Lys et al.
6,975,523 B2 12/2005 Kim et al.
6,980,446 B2 12/2005 Simada et al.
7,003,023 B2 2/2006 Krone et al.
7,034,611 B2 4/2006 Oswal et al.
7,050,509 B2 5/2006 Krone et al.
7,064,498 B2 6/2006 Dowling et al.
7,064,531 B1 6/2006 Zinn
7,072,191 B2 7/2006 Nakao et al.
7,075,329 B2 7/2006 Chen et al.
7,078,963 B1 7/2006 Andersen et al.
7,088,059 B2 8/2006 McKinney et al.
7,099,163 B1 8/2006 Ying
7,102,902 B1 9/2006 Brown et al.
7,106,603 B1 9/2006 Lin et al.
7,109,791 B1 9/2006 Epperson et al.
7,126,288 B2 10/2006 Ribarich et al.
7,135,824 B2 11/2006 Lys et al.
7,158,633 B1 1/2007 Hein
7,161,816 B2 1/2007 Shteynberg et al.
7,180,250 B1 2/2007 Gannon
7,221,130 B2 5/2007 Ribeiro et al.
7,233,135 B2 6/2007 Noma et al.
7,246,919 B2 7/2007 Porchia et al.
7,255,457 B2 8/2007 Ducharm et al.
7,266,001 B1 9/2007 Notohamiprodjo et al.
7,276,861 B1 10/2007 Shteynberg et al.
7,288,902 B1 10/2007 Melanson
7,292,013 B1 11/2007 Chen et al.
7,310,244 B2 12/2007 Yang et al.
7,345,458 B2 3/2008 Kanai et al.
7,375,476 B2 5/2008 Walter et al.
7,388,764 B2 6/2008 Huynh et al.
7,394,210 B2 7/2008 Ashdown
7,511,437 B2 3/2009 Lys et al.
7,538,499 B2 5/2009 Ashdown
7,545,130 B2 6/2009 Latham
7,554,473 B2 6/2009 Melanson
7,569,996 B2 8/2009 Holmes et al.
7,583,136 B2 9/2009 Pelly
7,642,734 B2 * 1/2010 De Anna ..... 315/308
7,656,103 B2 2/2010 Shteynberg et al.
7,667,986 B2 2/2010 Artusi et al.
7,710,047 B2 5/2010 Shteynberg et al.
7,719,246 B2 5/2010 Melanson
7,719,248 B1 5/2010 Melanson
7,746,043 B2 6/2010 Melanson
7,746,671 B2 6/2010 Radecker et al.
7,750,738 B2 7/2010 Bach
7,756,896 B1 7/2010 Feingold

| | | | | |
|---|---|---|---|---|
| 7,777,563 | B2 | 8/2010 | Midya et al. | |
| 7,804,256 | B2 | 9/2010 | Melanson | |
| 7,804,480 | B2 | 9/2010 | Jeon et al. | |
| 2002/0065583 | A1 | 5/2002 | Okada | |
| 2002/0150151 | A1 | 10/2002 | Krone et al. | |
| 2003/0095013 | A1 | 5/2003 | Melanson et al. | |
| 2003/0174520 | A1 | 9/2003 | Bimbaud | |
| 2004/0004465 | A1 | 1/2004 | McGinnis | |
| 2004/0046683 | A1 | 3/2004 | Mitamura et al. | |
| 2004/0212321 | A1* | 10/2004 | Lys et al. | 315/291 |
| 2004/0227571 | A1 | 11/2004 | Kuribayashi | |
| 2004/0228116 | A1 | 11/2004 | Miller et al. | |
| 2004/0232971 | A1 | 11/2004 | Kawasaki et al. | |
| 2005/0057237 | A1 | 3/2005 | Clavel | |
| 2005/0156770 | A1 | 7/2005 | Melanson | |
| 2005/0168492 | A1 | 8/2005 | Hekstra et al. | |
| 2005/0197952 | A1 | 9/2005 | Shea et al. | |
| 2005/0207190 | A1 | 9/2005 | Gritter | |
| 2005/0218838 | A1 | 10/2005 | Lys | |
| 2005/0222881 | A1 | 10/2005 | Booker | |
| 2005/0270813 | A1 | 12/2005 | Zhang et al. | |
| 2005/0275354 | A1 | 12/2005 | Hausman et al. | |
| 2005/0275386 | A1 | 12/2005 | Jepsen et al. | |
| 2006/0002110 | A1 | 1/2006 | Dowling | |
| 2006/0022916 | A1 | 2/2006 | Aiello | |
| 2006/0023002 | A1 | 2/2006 | Hara et al. | |
| 2006/0116898 | A1 | 6/2006 | Peterson | |
| 2006/0184414 | A1 | 8/2006 | Pappas et al. | |
| 2006/0214603 | A1 | 9/2006 | Oh et al. | |
| 2006/0226795 | A1 | 10/2006 | Walter et al. | |
| 2006/0238136 | A1 | 10/2006 | Johnson, III et al. | |
| 2006/0261754 | A1 | 11/2006 | Lee | |
| 2006/0285365 | A1 | 12/2006 | Huynh et al. | |
| 2007/0024213 | A1 | 2/2007 | Shteynberg et al. | |
| 2007/0029946 | A1 | 2/2007 | Yu et al. | |
| 2007/0040512 | A1 | 2/2007 | Jungwirth et al. | |
| 2007/0053182 | A1 | 3/2007 | Robertson | |
| 2007/0055564 | A1 | 3/2007 | Fourman | |
| 2007/0103949 | A1 | 5/2007 | Tsuruya | |
| 2007/0124615 | A1 | 5/2007 | Orr | |
| 2007/0126656 | A1 | 6/2007 | Huang et al. | |
| 2007/0170873 | A1* | 7/2007 | Mishima | 315/291 |
| 2007/0182699 | A1 | 8/2007 | Ha et al. | |
| 2007/0285031 | A1 | 12/2007 | Shteynberg et al. | |
| 2008/0012502 | A1 | 1/2008 | Lys | |
| 2008/0027841 | A1 | 1/2008 | Eder | |
| 2008/0043504 | A1 | 2/2008 | Ye et al. | |
| 2008/0054815 | A1 | 3/2008 | Kotikalapoodi et al. | |
| 2008/0116818 | A1 | 5/2008 | Shteynberg et al. | |
| 2008/0130322 | A1 | 6/2008 | Artusi et al. | |
| 2008/0130336 | A1 | 6/2008 | Taguchi | |
| 2008/0150433 | A1 | 6/2008 | Tsuchida et al. | |
| 2008/0154679 | A1 | 6/2008 | Wade | |
| 2008/0174291 | A1 | 7/2008 | Hansson et al. | |
| 2008/0174372 | A1 | 7/2008 | Tucker et al. | |
| 2008/0175029 | A1 | 7/2008 | Jung et al. | |
| 2008/0192509 | A1 | 8/2008 | Dhuyvetter et al. | |
| 2008/0224635 | A1 | 9/2008 | Hayes | |
| 2008/0232141 | A1 | 9/2008 | Artusi et al. | |
| 2008/0239764 | A1 | 10/2008 | Jacques et al. | |
| 2008/0259655 | A1 | 10/2008 | Wei et al. | |
| 2008/0278132 | A1 | 11/2008 | Kesterson et al. | |
| 2009/0067204 | A1 | 3/2009 | Ye et al. | |
| 2009/0070188 | A1 | 3/2009 | Scott et al. | |
| 2009/0147544 | A1 | 6/2009 | Melanson | |
| 2009/0174479 | A1 | 7/2009 | Yan et al. | |
| 2009/0218960 | A1 | 9/2009 | Lyons et al. | |
| 2010/0141317 | A1 | 6/2010 | Szajnowski | |

FOREIGN PATENT DOCUMENTS

| | | | |
|---|---|---|---|
| EP | 0632679 | | 1/1995 |
| EP | 0838791 | | 4/1998 |
| EP | 0910168 | A1 | 4/1999 |
| EP | 1014563 | | 6/2000 |
| EP | 1460775 | | 9/2004 |
| EP | 2204905 | A1 | 7/2010 |
| GB | 2069269 | A | 8/1981 |
| JP | WO 2006/022107 | A2 | 3/2006 |
| WO | WO9725836 | | 7/1997 |
| WO | 01/15316 | A1 | 1/2001 |
| WO | 02/15386 | A2 | 2/2002 |
| WO | W00227944 | | 4/2002 |
| WO | WO2006013557 | | 2/2006 |
| WO | WO2006135584 | | 12/2006 |
| WO | WO2008072160 | | 6/2008 |
| WO | WO2008152838 | | 12/2008 |
| WO | 2008731959 | | 4/2010 |

OTHER PUBLICATIONS

Maksimovic, Regan Zane and Robert Erickson, Impact of Digital Control in Power Electronics, Proceedings of 2004 International Symposium on Power Semiconductor Devices & Ics, Kitakyushu Apr. 5, 2010, Colorado Power Electronics Center, ECE Department, University of Colorado, Boulder, CO.

Mamano, Bob, "Current Sensing Solutions for Power Supply Designers", Unitrode Seminar Notes SEM1200, 1999.

http://toolbarpdf.com/docs/functions-and-features-of-inverters.html printed on Jan. 20, 2011.

CN 28508 Office Action Nov. 25, 2010.

English Translation of CN 28508 Office Action Nov. 25, 2010.

Power Integrations, Inc., "TOP200-4114 TOPSwitch Family Three-terminal Off-line PWM Switch", XP-002524650, Jul. 1996, Sunnyvale, California.

Texas Instruments, SLOS318F, "High-Speed, Low Noise, Fully-Differential I/O Amplifiers," THS4130 and THS4131, US, Jan. 2006.

International Search Report and Written Opinion, PCT US20080062387, dated Feb. 5, 2008.

International Search Report and Written Opinion, PCT US200900032358, dated Jan. 29, 2009.

Hirota, Atsushi et al, "Analysis of Single Switch Delta-Sigma Modulated Pulse Space Modulation PFC Converter Effectively Using Switching Power Device," IEEE, US, 2002.

Prodic, Aleksandar, "Digital Controller for High-Frequency Rectifiers with Power Factor Correction Suitable for On-Chip Implementation," IEEE, US, 2007.

International Search Report and Written Opinion, PCT US20080062378, dated Feb. 5, 2008.

International Search Report and Written Opinion, PCT US20090032351, dated Jan. 29, 2009.

Erickson, Robert W. et al, "Fundamentals of Power Electronics," Second Edition, Chapter 6, Boulder, CO, 2001.

Allegro Microsystems, A1442, "Low Voltage Full Bridge Brushless DC Motor Driver with Hall Commutation and Soft-Switching, and Reverse Battery, Short Circuit, and Thermal Shutdown Protection," Worcester MA, 2009.

Texas Instruments, SLUS828B, "8-Pin Continuous Conduction Mode (CCM) PFC Controller", UCC28019A, US, revised Apr. 2009.

Analog Devices, "120 kHz Bandwidth, Low Distortion, Isolation Amplifier", AD215, Norwood, MA, 1996.

Burr-Brown, ISO120 and ISO121, "Precision Los Cost Isolation Amplifier," Tucson AZ, Mar. 1992.

Burr-Brown, ISO130, "High IMR, Low Cost Isolation Amplifier," SBOS220, US, Oct. 2001.

International Search Report and Written Report PCT US20080062428 dated Feb. 5, 2008.

Prodic, A. et al, "Dead Zone Digital Controller for Improved Dynamic Response of Power Factor Preregulators," IEEE, 2003.

Linear Technology, "Single Switch PWM Controller with Auxiliary Boost Converter," LT1950 Datasheet, Linear Technology, Inc. Milpitas, CA, 2003.

Yu, Zhenyu, 3.3V DSP for Digital Motor Control, Texas Instruments, Application Report SPRA550 dated Jun. 1999.

International Rectifier, Data Sheet No. PD60143-0, Current Sensing Single Channel Driver, El Segundo, CA, dated Sep. 8, 2004.

Balogh, Laszlo, "Design and Application Guide for High Speed MOSFET Gate Drive Circuits" [Online] 2001, Texas Instruments, Inc., SEM-1400, Unitrode Power Supply Design Seminar, Topic II, TI literature No. SLUP133, XP002552367, Retrieved from the Internet: URL:htt://focus.ti.com/lit/ml/slup169/slup169.pdf the whole document.

PCT US2008/056608 International Preliminary Report on Patentability and Written Opinion dated Sep. 15, 2009.
PCT US2009/051746, International Search Report and Written Opinion dated Sep. 1, 2009.
PCT &S09/51757.International Search Report and Written Opinion dated Aug. 28, 2009.
Infineon, CCM-PFC Standalone Power Factor Correction (PFC) Controller in Continuous Conduction Mode (CCM), Version 2.1, Feb. 6, 2007.
International Rectifier, IRAC1150-300W Demo Board, User's Guide, Rev 3.0, Aug. 2, 2005.
International Rectifier, Application Note AN-1077,PFC Converter Design with IR1150 One Cycle Control IC, rev. 2.3, Jun. 2005.
International Rectifier, Data Sheet PD60230 revC, Feb. 5, 2007.
Lu et al., International Rectifier, Bridgeless PFC Implementation Using One Cycle Control Technique, 2005.
Linear Technology, LT1248, Power Factor Controller, Apr. 20, 2007.
On Semiconductor, AND8123/D, Power Factor Correction Stages Operating in Critical Conduction Mode, Sep. 2003.
On Semiconductor, MC33260, GreenLine Compact Power Factor Controller: Innovative Circuit for Cost Effective Solutions, Sep. 2005.
On Semiconductor, NCP1605, Enhanced, High Voltage and Efficient Standby Mode, Power Factor Controller, Feb. 2007.
On Semconductor, NCP1606, Cost Effective Power Factor Controller, Mar. 2007.
On Semiconductor, NCP1654, Product Review, Power Factor Controller for Compact and Robust, Continuous Conduction Mode Pre-Converters, Mar. 2007.
Philips, Application Note, 90W Resonant SMPS with TEA1610 SwingChip, AN99011, 1999.
NXP, TEA1750, GreenChip III SMPS control IC Product Data Sheet, Apr. 6, 2007.
Renesas, HA16174P/FP, Power Factor Correction Controller IC, Jan. 6, 2006.
Renesas Technology Releases Industry's First Critical-Conduction-Mode Power Factor Correction Control IC Implementing Interleaved Operation, Dec. 18, 2006.
Renesas, Application Note R2A20111 EVB, PFC Control IC R2A20111 Evaluation Board, Feb. 2007.
STMicroelectronics, L6563, Advanced Transition-Mode PFC Controller, Mar. 2007.
Texas Instruments, Application Note SLUA321, Startup Current Transient of the Leading Edge Triggered PFC Controllers, Jul. 2004.
Texas Instruments, Application Report, SLUA309A, Avoiding Audible Noise at Light Loads when using Leading Edge Triggered PFC Converters, Sep. 2004.
Texas Instruments, Application Report SLUA369B, 350-W, Two-Phase Interleaved PFC Pre-Regulator Design Review, Mar. 2007.
Unitrode, High Power-Factor Preregulator, Oct. 1994.
Texas Instruments, Transition Mode PFC Controller, SLUS515D, Jul. 2005.
Unitrode Products From Texas Instruments, Programmable Output Power Factor Preregulator, Dec. 2004.
Unitrode Products From Texas Instruments, High Performance Power Factor Preregulator, Oct. 2005.
Texas Instruments, UCC3817 BiCMOS Power Factor Preregulator Evaluation Board User's Guide, Nov. 2002.
Unitrode, L. Balogh, Design Note UC3854A/B and UC3855A/B Provide Power Limiting with Sinusoidal Input Current for PFC Front Ends, SLUA196A, Nov. 2001.
A. Silva De Morais et al., A High Power Factor Ballast Using a Single Switch with Both Power Stages Integrated, IEEE Transactions on Power Electronics, vol. 21, No. 2, Mar. 2006.
M. Ponce et al., High-Efficient Integrated Electronic Ballast for Compact Fluorescent Lamps, IEEE Transactions on Power Electronics, vol. 21, No. 2, Mar. 2006.
A. R. Seidel et al., A Practical Comparison Among High-Power-Factor Electronic Ballasts with Similar Ideas, IEEE Transactions on Industry Applications, vol. 41, No. 6, Nov.-Dec. 2005.
F. T. Wakabayashi et al., An Improved Design Procedure for LCC Resonant Filter of Dimmable Electronic Ballasts for Fluorescent Lamps, Based on Lamp Model, IEEE Transactions on Power Electronics, vol. 20, No. 2, Sep. 2005.
J. A. Vilela Jr. et al., An Electronic Ballast with High Power Factor and Low Voltage Stress, IEEE Transactions on Industry Applications, vol. 41, No. 4, Jul./Aug. 2005.
S. T.S. Lee et al., Use of Saturable Inductor to Improve the Dimming Characteristics of Frequency-Controlled Dimmable Electronic Ballasts, IEEE Transactions on Power Electronics, vol. 19, No. 6, Nov. 2004.
M. K. Kazimierczuk et al., Electronic Ballast for Fluorescent Lamps, IEEETransactions on Power Electronics, vol. 8, No. 4, Oct. 1993.
S. Ben-Yaakov et al., Statics and Dynamics of Fluorescent Lamps Operating at High Frequency: Modeling and Simulation, IEEE Transactions on Industry Applications, vol. 38, No. 6, Nov.-Dec. 2002.
H. L. Cheng et al., A Novel Single-Stage High-Power-Factor Electronic Ballast with Symmetrical Topology, IEEE Transactions on Power Electronics, vol. 50, No. 4, Aug. 2003.
J.W.F. Dorleijn et al., Standardisation of the Static Resistances of Fluorescent Lamp Cathodes and New Data for Preheating, Industry Applications Conference, vol. 1, Oct. 13, 2002-Oct. 18, 2002.
Q. Li et al., An Analysis of the ZVS Two-Inductor Boost Converter under Variable Frequency Operation, IEEE Transactions on Power Electronics, vol. 22, No. 1, Jan. 2007.
H. Peng et al., Modeling of Quantization Effects in Digitally Controlled DC-DC Converters, IEEE Transactions on Power Electronics, vol. 22, No. 1, Jan. 2007.
G.Yao et al., Soft Switching Circuit for Interleaved Boost Converters, IEEE Transactions on Power Electronics, vol. 22, No. 1, Jan. 2007.
C. M. De Oliviera Stein et al., A ZCT Auxiliary Communication Circuit for Interleaved Boost Converters in Operating in Critical Conduction Mode, IEEE Transactions on Power Electronics, vol. 17, No. 6, Nov. 2002.
W. Zhang et al., A New Duty Cycle Control Strategy for Power Factor Correction and FPGA Implementation, IEEE Transactions on Power Electronics, vol. 21, No. 6, Nov. 2006.
H. Wu et al., Single Phase Three-Level Power Factor Correction Circuit with Passive Lossless Snubber, IEEE Transactions on Power Electronics, vol. 17, No. 2, Mar. 2006.
O. Garcia et al., High Efficiency PFC Converter to Meet EN61000-3-2 and A14, Proceedings of the 2002 IEEE International Symposium on Industrial Electronics, vol. 3, 2002.
P. Lee et al., Steady-State Analysis of an Interleaved Boost Converter with Coupled Inductors, IEEE Transactions on Industrial Electronics, vol. 47, No. 4, Aug. 2000.
D.K.W. Cheng et al., A New Improved Boost Converter with Ripple Free Input Current Using Coupled Inductors, Power Electronics and Variable Speed Drives, Sep. 21-23, 1998.
B.A. Miwa et al., High Efficiency Power Factor Correction Using Interleaved Techniques, Applied Power Electronics Conference and Exposition, Seventh Annual Conference Proceedings, Feb. 23-27, 1992.
Z. Lai et al., A Family of Power-Factor-Correction Controllers, Twelfth Annual Applied Power Electronics Conference and Exposition, vol. 1, Feb. 23, 1997-Feb. 27, 1997.
L. Balogh et al., Power-Factor Correction with Interleaved Boost Converters in Continuous-Inductor-Current Mode, Eighth Annual Applied Power Electronics Conference and Exposition, 1993. APEC '93. Conference Proceedings, Mar. 7, 1993-Mar. 11, 1993.
Fairchild Semiconductor, Application Note 42030, Theory and Application of the ML4821 Average Current Mode PFC Controller, Oct. 25, 2000.
Unitrode Products From Texas Instruments, BiCMOS Power Factor Preregulator, Feb. 2006.
Texas Instruments, Interleaving Continuous Conduction Mode PFC Controller, UCC28070, SLUS794C, Nov. 2007, revised Jun. 2009, Texas Instruments, Dallas TX.
Freescale Semiconductor, Inc., Dimmable Light Ballast with Power Factor Correction, Design Reference Manual, DRM067, Rev. 1, Dec. 2005.

J. Zhou et al., Novel Sampling Algorithm for DSP Controlled 2 kW PFC Converter, IEEE Transactions on Power Electronics, vol. 16, No. 2, Mar. 2001.
A. Prodic, Compensator Design and Stability Assessment for Fast Voltage Loops of Power Factor Correction Rectifiers, IEEE Transactions on Power Electronics, vol. 22, No. 5, Sep. 2007.
M. Brkovic et al., "Automatic Current Shaper with Fast Output Regulation and Soft-Switching," S.15.C Power Converters, Telecommunications Energy Conference, 1993.
Dallas Semiconductor, Maxim, "Charge-Pump and Step-Up DC-DC Converter Solutions for Powering White LEDs in Series or Parallel Connections," Apr. 23, 2002.
Freescale Semiconductor, AN3052, Implementing PFC Average Current Mode Control Using the MC9S12E128, Nov. 2005.
D. Maksimovic et al., "Switching Converters with Wide DC Conversion Range," Institute of Electrical and Electronic Engineer's (IEEE) Transactions on Power Electronics, Jan. 1991.
V. Nguyen et al., "Tracking Control of Buck Converter Using Sliding-Mode with Adaptive Hysteresis," Power Electronics Specialists Conference, 1995. PESC apos; 95 Record., 26th Annual IEEE vol. 2, Issue , Jun. 18-22, 1995 pp. 1086-1093.
S. Zhou et al., "A High Efficiency, Soft Switching DC-DC Converter with Adaptive Current-Ripple Control for Portable Applications," IEEE Transactions on Circuits and Systems—II: Express Briefs, vol. 53, No. 4, Apr. 2006.
K. Leung et al., "Use of State Trajectory Prediction in Hysteresis Control for Achieving Fast Transient Response of the Buck Converter," Circuits and Systems, 2003. ISCAS apos;03. Proceedings of the 2003 International Symposium, vol. 3, Issue , May 25-28, 2003 pp. III-439-III-442 vol. 3.
K. Leung et al., "Dynamic Hysteresis Band Control of the Buck Converter with Fast Transient Response," IEEE Transactions on Circuits and Systems—II: Express Briefs, vol. 52, No. 7, Jul. 2005.
Y. Ohno, Spectral Design Considerations for White LED Color Rendering, Final Manuscript, Optical Engineering, vol. 44, 111302 (2005).
S. Skogstad et al., A Proposed Stability Characterization and Verification Method for High-Order Single-Bit Delta-Sigma Modulators, Norchip Conference, Nov. 2006 http://folk.uio.no/savskogs/pub/A_Proposed_Stability_Characterization.pdf.
J. Turchi, Four Key Steps to Design a Continuous Conduction Mode PFC Stage Using the NCP1653, on Semiconductor, Publication Order No. AND184/D, Nov. 2004.
Megaman, D or S Dimming ESL, Product News, Mar. 15, 2007.
J. Qian et al., New Charge Pump Power-Factor-Correction Electronic Ballast with a Wide Range of Line Input Voltage, IEEE Transactions on Power Electronics, vol. 14, No. 1, Jan. 1999.
P. Green, A Ballast that can be Dimmed from a Domestic (Phase-Cut) Dimmer, IRPLCFL3 rev. b, International Rectifier, http://www.irf.com/technical-info/refdesigns/cf1-3.pdf, printed Mar. 24, 2007.
J. Qian et al., Charge Pump Power-Factor-Correction Technologies Part II: Ballast Applications, IEEE Transactions on Power Electronics, vol. 15, No. 1, Jan. 2000.
Chromacity Shifts in High-Power White LED Systems due to Different Dimming Methods, Solid-State Lighting, http://www.lrc.rpi.edu/programs/solidstate/completedProjects.asp?ID=76, printed May 3, 2007.
S. Chan et al., Design and Implementation of Dimmable Electronic Ballast Based on Integrated Inductor, IEEE Transactions on Power Electronics, vol. 22, No. 1, Jan. 2007.
M. Madigan et al., Integrated High-Quality Rectifier-Regulators, IEEE Transactions on Industrial Electronics, vol. 46, No. 4, Aug. 1999.
T. Wu et al., Single-Stage Electronic Ballast with Dimming Feature and Unity Power Factor, IEEE Transactions on Power Electronics, vol. 13, No. 3, May 1998.
F. Tao et al., "Single-Stage Power-Factor-Correction Electronic Ballast with a Wide Continuous Dimming Control for Fluorescent Lamps," IEEE Power Electronics Specialists Conference, vol. 2, 2001.
Azoteq, IQS17 Family, IQ Switch®—ProxSense™ Series, Touch Sensor, Load Control and User Interface, IQS17 Datasheet V2.00.doc, Jan. 2007.
C. Dilouie, Introducing the LED Driver, EC&M, Sep. 2004.
S. Lee et al., TRIAC Dimmable Ballast with Power Equalization, IEEE Transactions on Power Electronics, vol. 20, No. 6, Nov. 2005.
L. Gonthier et al., EN55015 Compliant 500W Dimmer with Low-Losses Symmetrical Switches, 2005 European Conference on Power Electronics and Applications, Sep. 2005.
Why Different Dimming Ranges? The Difference Between Measured and Perceived Light, 2000 http://www.lutron.com/ballast/pdf/LutronBallastpg3.pdf.
D. Hausman, Real-Time Illumination Stability Systems for Trailing-Edge (Reverse Phase Control) Dimmers, Technical White Paper, Lutron, version 1.0, Dec. 2004, http://www.lutron.com/technical_info/pdf/RTISS-TE.pdf.
Light Dimmer Circuits, www.epanorama.net/documents/lights/lightdimmer.html, printed Mar. 26, 2007.
Light Emitting Diode, http://en.wikipedia.org/wiki/Light-emitting_diode, printed Mar. 27, 2007.
Color Temperature, www.sizes.com/units/color_temperature.htm, printed Mar. 27, 2007.
S. Lee et al., A Novel Electrode Power Profiler for Dimmable Ballasts Using DC Link Voltage and Switching Frequency Controls, IEEE Transactions on Power Electronics, vol. 19, No. 3, May 2004.
Y. Ji et al., Compatibility Testing of Fluorescent Lamp and Ballast Systems, IEEE Transactions on Industry . Applications, vol. 35, No. 6, Nov./Dec. 1999.
National Lighting Product Information Program, Specifier Reports, "Dimming Electronic Ballasts," vol. 7, No. 3, Oct. 1999.
Supertex Inc., Buck-based LED Drivers Using the HV9910B, Application Note AN-H48, Dec. 28, 2007.
D. Rand et al, Issues, Models and Solutions for Triac Modulated Phase Dimming of LED Lamps, Power Electronics Specialists Conference, 2007.
Supertex Inc., HV9931 Unity Power Factor LED Lamp Driver, Application Note AN-H52, Mar. 7, 2007.
Supertex Inc., 56W Off-line LED Driver, 120VAC with PFC, 160V, 350mA Load, Dimmer Switch Compatible, DN-H05, Feb. 2007.
ST Microelectronics, Power Factor Corrector L6561, Jun. 2004.
Fairchild Semiconductor, Application Note 42047 Power Factor Correction (PFC) Basics, Rev. 0.9.0 Aug. 19, 2004.
M. Radecker et al., Application of Single-Transistor Smart-Power IC for Fluorescent Lamp Ballast, Thirty-Fourth Annual Industry Applications Conference IEEE, vol. 1, Oct. 3, 1999-Oct. 7, 1999.
M. Rico-Secades et al., Low Cost Electronic Ballast for a 36-W Fluorescent Lamp Based on a Current-Mode-Controlled Boost Inverter for a 120-V DC Bus Power Distribution, IEEE Transactions on Power Electronics, vol. 21, No. 4, Jul. 2006.
Fairchild Semiconductor, FAN4800, Low Start-up Current PFC/PWM Controller Combos, Nov. 2006.
Fairchild Semiconductor, FAN4810, Power Factor Correction Controller, Sep. 24, 2003.
Fairchild Semiconductor, FAN4822, ZVS Average Current PFC Controller, Aug. 10, 2001.
Fairchild Semiconductor, FAN7527B, Power Factor Correction Controller, 2003.
Fairchild Semiconductor, ML4821, Power Factor Controller, Jun. 19, 2001.
Freescale Semiconductor, AN1965, Design of Indirect Power Factor Correction Using 56F800/E, Jul. 2005.
International Search Report for PCT/US2008/051072, mailed Jun. 4, 2008.
D. Hausman, Lutron, RTISS-TE Operation, Real-Time Illumination Stability Systems for Trailing-Edge (Reverse Phase Control) Dimmers, v. 1.0 Dec. 2004.
International Rectifier, Data Sheet No. PD60230 revC, IR1150(S)(PbF), uPFC One Cycle Control PFC IC Feb. 5, 2007.
Texas Instruments, Application Report SLUA308, UCC3817 Current Sense Transformer Evaluation, Feb. 2004.
Texas Instruments, Application Report SPRA902A, Average Current Mode Controlled Power Factor Correctiom Converter using TMS320LF2407A, Jul. 2005.
Unitrode, Design Note DN-39E, Optimizing Performance in UC3854 Power Factor Correction Applications, Nov. 1994.

Fairchild Semiconductor, Application Note 42030, Theory and Application of the ML4821 Average Currrent Mode PFC Controller, Aug. 1997.
Fairchild Semiconductor, Application Note AN4121, Design of Power Factor Correction Circuit Using FAN7527B, Rev.1.0.1, May 30, 2002.
Fairchild Semiconductor, Application Note 6004, 500W Power-Factor-Corrected (PFC) Converter Design with FAN4810, Rev. 1.0.1, Oct. 31, 2003.
Fairchild Semiconductor, FAN4822, ZVA Average Current PFC Controller, Rev. 1.0.1 Aug. 10, 2001.
Fairchild Semiconductor, ML4821, Power Factor Controller, Rev. 1.0.2, Jun. 19, 2001.
Fairchild Semiconductor, ML4812, Power Factor Controller, Rev. 1.0.4, May 31, 2001.
Linear Technology, 100 Watt LED Driver, Linear Technology, 2006.
Fairchild Semiconductor, FAN7544, Simple Ballast Controller, Rev. 1.0.0, 2004.
Fairchild Semiconductor, FAN7532, Ballast Controller, Rev. 1.0.2, Jun. 2006.
Fairchild Semiconductor, FAN7711, Ballast Control IC, Rev. 1.0.2, Mar. 2007.
Fairchild Semiconductor, KA7541, Simple Ballast Controller, Rev. 1.0.3, 2001.
ST Microelectronics, L6574, CFL/TL Ballast Driver Preheat and Dimming, Sep. 2003.
ST Microelectronics, AN993, Application Note, Electronic Ballast with PFC Using L6574 and L6561, May 2004.
International Search Report and Written Opinion for PCT/US2008/062384 dated Jan. 14, 2008.
S. Dunlap et al., Design of Delta-Sigma Modulated Switching Power Supply, Circuits & Systems, Proceedings of the 1998 IEEE International Symposium, 1998.

* cited by examiner

LIGHTING SYSTEM WITH LIGHTING DIMMER OUTPUT MAPPING

CROSS-REFERENCE TO RELATED APPLICATION

This application is a divisional application of application Ser. No. 11/695,024, filed Apr. 1, 2007 now U.S. Pat. No. 7,667,408, which is incorporated herein by reference in its entirety.

This application claims the benefit under 35 U.S.C. §119 (e) and 37 C.F.R. §1.78 of U.S. Provisional Application No. 60/894,295, filed Mar. 12, 2007 and entitled "Lighting Fixture". U.S. Provisional Application No. 60/894,295 includes exemplary systems and methods and is incorporated by reference in its entirety.

U.S. Provisional Application entitled "Ballast for Light Emitting Diode Light Sources", inventor John L. Melanson, 60/909,458, and filed on Mar. 31, 2007 describes exemplary methods and systems and is incorporated by reference in its entirety.

U.S. patent application entitled "Color Variations in a dimmable Lighting Device with Stable Color Temperature Light Sources", inventor John L. Melanson, Ser. No. 11/695,023, and filed on Mar. 31, 2007 describes exemplary methods and systems and is incorporated by reference in its entirety.

U.S. Provisional Application entitled "Multi-Function Duty Cycle Modifier", inventors John L. Melanson and John Paulos, 60/909,457, and filed on Mar. 31, 2007 describes exemplary methods and systems and is incorporated by reference in its entirety.

BACKGROUND OF THE INVENTION

1. Field of the Invention

The present invention relates in general to the field of electronics, and more specifically to a system and method for mapping an output of a lighting dimmer in a lighting system to predetermined lighting output functions.

2. Description of the Related Art

Commercially practical incandescent light bulbs have been available for over 100 years. However, other light sources show promise as commercially viable alternatives to the incandescent light bulb. Gas discharge light sources, such as fluorescent, mercury vapor, low pressure sodium, and high pressure sodium lights and electroluminescent light sources, such as a light emitting diode (LED), represent two categories of light source alternatives to incandescent lights. LEDs are becoming particularly attractive as main stream light sources in part because of energy savings through high efficiency light output and environmental incentives such as the reduction of mercury.

Incandescent lights generate light by passing current through a filament located within a vacuum chamber. The current causes the filament to heat and produce light. The filament produces more heat as more current passes through the filament. For a clear vacuum chamber, the temperature of the filament determines the color of the light. A lower temperature results in yellowish tinted light and a high temperature results in a bluer, whiter light.

Gas discharge lamps include a housing that encloses gas. The housing is terminated by two electrodes. The electrodes are charged to create a voltage difference between the electrodes. The charged electrodes heat and cause the enclosed gas to ionize. The ionized gas produces light. Fluorescent lights contain mercury vapor that produces ultraviolet light.

The housing interior of the fluorescent lights include a phosphor coating to convert the ultraviolet light into visible light.

LEDs are semiconductor devices and are driven by direct current. The lumen output intensity (i.e. brightness) of the LED varies approximately in direct proportion to the current flowing through the LED. Thus, increasing current supplied to an LED increases the intensity of the LED, and decreasing current supplied to the LED dims the LED. Current can be modified by either directly reducing the direct current level to the white LEDs or by reducing the average current through pulse width modulation.

Dimming a light source saves energy when operating a light source and also allows a user to adjust the intensity of the light source to a desired level. Many facilities, such as homes and buildings, include light source dimming circuits (referred to herein as a "dimmer").

FIG. 1A depicts a lighting circuit 100 with a conventional dimmer 102 for dimming incandescent light source 104 in response to inputs to variable resistor 106. The dimmer 102, light source 104, and voltage source 108 are connected in series. Voltage source 108 supplies alternating current at line voltage $V_{line}$. The line voltage $V_{line}$ can vary depending upon geographic location. The line voltage $V_{line}$ is typically 110-120 Vac or 220-240 Vac with a typical frequency of 60 Hz or 70 Hz. Instead of diverting energy from the light source 104 into a resistor, dimmer 102 switches the light source 104 off and on many times every second to reduce the total amount of energy provided to light source 104. A user can select the resistance of variable resistor 106 and, thus, adjust the charge time of capacitor 110. A second, fixed resistor 112 provides a minimum resistance when the variable resistor 106 is set to 0 ohms. When capacitor 110 charges to a voltage greater than a trigger voltage of diac 114, the diac 114 conducts and the gate of triac 116 charges. The resulting voltage at the gate of triac 116 and across bias resistor 118 causes the triac 116 to conduct. When the current I passes through zero, the triac 116 becomes nonconductive, (i.e. turns 'off'). When the triac 116 is nonconductive, dimmer output voltage $V_{DIM}$ is 0 V. When triac 116 conducts, the dimmer output voltage $V_{DIM}$ equals the line voltage $V_{line}$. The charge time of capacitor 110 required to charge capacitor 110 to a voltage sufficient to trigger diac 114 depends upon the value of current I. The value of current I depends upon the resistance of variable resistor 106 and resistor 112.

In at least one embodiment, the duty cycles, and, correspondingly, the phase angle, of dimmer output voltage $V_{DIM}$ represent dimming levels of dimmer 102. The limitations upon conventional dimmer 102 prevent duty cycles of 100% to 0% and generally can range from 95% to 10%. Thus, adjusting the resistance of variable resistor 106 adjusts the phase angle and, thus, the dimming level represented by the dimmer output voltage $V_{DIM}$. Adjusting the phase angle of dimmer output voltage $V_{DIM}$ modifies the average power to light source 104, which adjusts the intensity of light source 104.

FIG. 1B depicts a lighting circuit 140 with a 3-wire conventional dimmer 150 for dimming incandescent light source 104. The conventional dimmer 150 can be microcontroller based. A pair of the wires carries the AC line voltage $V_{line}$ to light source controller/driver 152. In another embodiment, the line voltage $V_{line}$ is applied directly to the light source controller/driver 152. A third wire carries a dimmer output signal value $D_V$ to light source controller/driver 152. In at least one embodiment, the dimmer 150 is a digital dimmer that receives a dimmer level user input from a user via, for example, push buttons, other switch types, or a remote control, and converts the dimmer level user input into the dimmer output signal value $D_V$. In at least one embodiment, the dimmer output signal value $D_V$ is digital data representing the selected dimming level or other dimmer function. The dimmer output signal value $D_V$ serves as a control signal for light source controller/driver 152. The light source controller/driver 152 receives the dimmer output signal value $D_V$ and provides a drive current to light source 104 that dims light source 104 to a dimming level indicated by dimmer output signal value $D_V$.

FIG. 2 depicts the duty cycles and corresponding phase angles of the modified dimmer output voltage $V_{DIM}$ waveform of dimmer 102. The dimmer output voltage oscillates during each period from a positive voltage to a negative voltage. (The positive and negative voltages are characterized with respect to a reference direct current (dc) voltage level, such as a neutral or common voltage reference.) The period of each full cycle 202.0 through 202.N is the same frequency as $V_{line}$, where N is an integer. The dimmer 102 chops the voltage half cycles 204.0 through 204.N and 206.0 through 206.N to alter the duty cycle and phase angle of each half cycle. The phase angles are measurements of the points in the cycles of dimmer output voltage $V_{DIM}$ at which chopping occurs. The dimmer 102 chops the positive half cycle 204.0 at time $t_1$ so that half cycle 204.0 is 0 V from time $t_0$ through time $t_1$ and has a positive voltage from time $t_1$ to time $t_2$. The light source 104 is, thus, turned 'off' from times $t_0$ through $t_1$ and turned 'on' from times $t_1$ through $t_2$. Dimmer 102 chops the positive half cycle 206.0 with the same timing as the negative half cycle 204.0. So, the phase angles of each half cycle of cycle 202.0 are the same. Thus, the full phase angle of dimmer 102 is directly related to the duty cycle for cycle 202.0. Equation [1] sets forth the duty cycle for cycle 202.0 is:

$$\text{Duty Cycle} = \frac{(t_2 - t_1)}{(t_2 - t_0)}. \quad [1]$$

When the resistance of variable resistance 106 is increased, the duty cycles and phase angles of dimmer 102 also decreases. Between time $t_2$ and time $t_3$, the resistance of variable resistance 106 is increased, and, thus, dimmer 102 chops the full cycle 202.N at later times in the positive half cycle 204.N and the negative half cycle 206.N of full cycle 202.N with respect to cycle 202.0. Dimmer 102 continues to chop the positive half cycle 204.N with the same timing as the negative half cycle 206.N. So, the duty cycles and phase angles of each half cycle of cycle 202.N are the same.

Since times $(t_5-t_4)<(t_2-t_1)$, less average power is delivered to light source 104 by the sine wave 202.N of dimmer voltage $V_{DIM}$, and the intensity of light source 104 decreases at time $t_3$ relative to the intensity at time $t_2$.

FIG. 3 depicts a measured light versus perceived light graph 300 representing typical percentages of measured light versus perceived light during dimming. The multiple dimming levels of dimmer 102 vary the measured light output of incandescent light source 104 in relation to the resistance of variable resistor 106. Thus, the measured light generated by the light source 104 is a function of the dimmer output voltage $V_{DIM}$. One hundred percent measured light represents the maximum, rated lumen output of the light source 104, and zero percent measured light represents no light output.

A human eye responds to decreases in the measured light percentage by automatically enlarging the pupil to allow more light to enter the eye. Allowing more light to enter the eye results in the perception that the light is actually brighter. Thus, the light perceived by the human is always greater than the measured light. For example, the curve 302 indicates that at 1% measured light, the perceived light is 10%. In one embodiment, measured light and perceived light percentages do not completely converge until measured light is approximately 100%.

Many lighting applications, such as architectural dimming, higher performance dimming, and energy management dimming, involve measured light varying from 1% to 10%. Because of the non-linear relationship between measured light and perceived light, dimmer 102 has very little dimming level range and can be very sensitive at low measured output light levels. Thus, the ability of dimmers to provide precision control at low measured light levels is very limited.

SUMMARY OF THE INVENTION

In one embodiment of the present invention, a method for mapping dimming output signal values of a lighting dimmer using a predetermined lighting output function and driving a light source in response to mapped digital data includes receiving a dimmer output signal and receiving a clock signal having a clock signal frequency. The method also includes detecting duty cycles of the dimmer output signal based on the clock signal frequency and converting the duty cycles of the dimmer output signal into digital data representing the detected duty cycles, wherein the digital data correlates to dimming levels. The method further includes mapping the digital data to light source control signals using the predetermined lighting output function and operating a light source in accordance with the light source control signals.

In another embodiment of the present invention a method for mapping dimming output signal values of a lighting dimmer using a predetermined lighting output function and operating a light source in response to mapped dimming output signal values includes receiving a dimmer output signal, wherein values of the dimmer output signal represent duty cycles having a range of approximately 95% to 10%. The method also includes mapping the dimmer output signal values to light source control signals using the predetermined lighting output function, wherein the predetermined lighting output function maps the dimmer output signal values to the light source control signals to provide an intensity range of the light source of greater than 95% to less than 5%. The method further includes operating a light source in accordance with the light source control signals.

In another embodiment of the present invention, a method for mapping dimming output signal values of a lighting dimmer using a predetermined lighting output function and driving a light source in response to mapped dimmer output signal values includes receiving a dimmer output signal, wherein values of the dimmer output signal represents one of multiple dimming levels. The method also includes applying a signal processing function to alter transition timing from a first light source intensity level to a second light source intensity level and mapping the dimmer output signal values to light source control signals using the predetermined lighting output function. The method further includes operating a light source in accordance with the light source control signals.

In another embodiment of the present invention, a lighting system includes one or more input terminals to receive a dimmer output signal and a duty cycle detector to detect duty cycles of the dimmer output signal generated by a lighting dimmer. The lighting system also includes a duty cycle to time converter to convert the duty cycles of the dimmer output signal into digital data representing the detected duty cycles, wherein the digital data correlates to dimming levels. The lighting system further includes circuitry to map the digital data to light source control signals using a predetermined lighting output function and a light source driver to operate a light source in accordance with the light source control signals.

In a further embodiment of the present invention, a lighting system includes one or more input terminals to receive a dimmer output signal, wherein values of the dimmer output signal represents one of multiple dimming levels. The lighting system also includes a filter to apply a signal processing function to alter transition timing from a first light source intensity level to a second light source intensity level and circuitry to map the dimmer output signal values to light source control signals using the predetermined lighting output function. The lighting system also includes a light source driver to operate a light source in accordance with signals derived from the light source control signals.

In another embodiment of the present invention, a lighting system for mapping dimming output signal values of a lighting dimmer using a predetermined lighting output function and operating a light source in response to mapped dimming output signal values includes one or more input terminals to receive a dimmer output signal, wherein values of the dimmer output signal represent duty cycles having a range of approximately 95% to 10%. The lighting system also includes circuitry to map the dimmer output signal values to light source control signals using the predetermined lighting output function, wherein the predetermined lighting output function maps the dimmer output signal values to the light source control signals to provide an intensity range of the light source of greater than 95% to less than 5%. The lighting system also includes a light source driver to operate a light source in accordance with the light source control signals.

BRIEF DESCRIPTION OF THE DRAWINGS

The present invention may be better understood, and its numerous objects, features and advantages made apparent to those skilled in the art by referencing the accompanying drawings. The use of the same reference number throughout the several figures designates a like or similar element.

DETAILED DESCRIPTION

A system and method map dimming levels of a lighting dimmer to light source control signals using a predetermined lighting output function. In at least one embodiment, the dimmer generates a dimmer output signal value. At any particular period of time, the dimmer output signal value represents one of multiple dimming levels. In at least one embodiment, the lighting output function maps the dimmer output signal values to any lighting output function such as a light level function, a timing function, or any other light source control function. In at least one embodiment, the lighting output function maps the dimmer output signal value to one or more different dimming values that is/are different than the dimming level represented by the dimmer output signal value. In at least one embodiment, the lighting output function converts a dimmer output signal values corresponding to measured light levels to perception based light levels. A light source driver operates a light source in accordance with the predetermined lighting output function. In at least one embodiment, the system and method includes a filter to apply a signal processing function to alter transition timing from a first light source intensity level to a second light source intensity level.

Figure 4A:
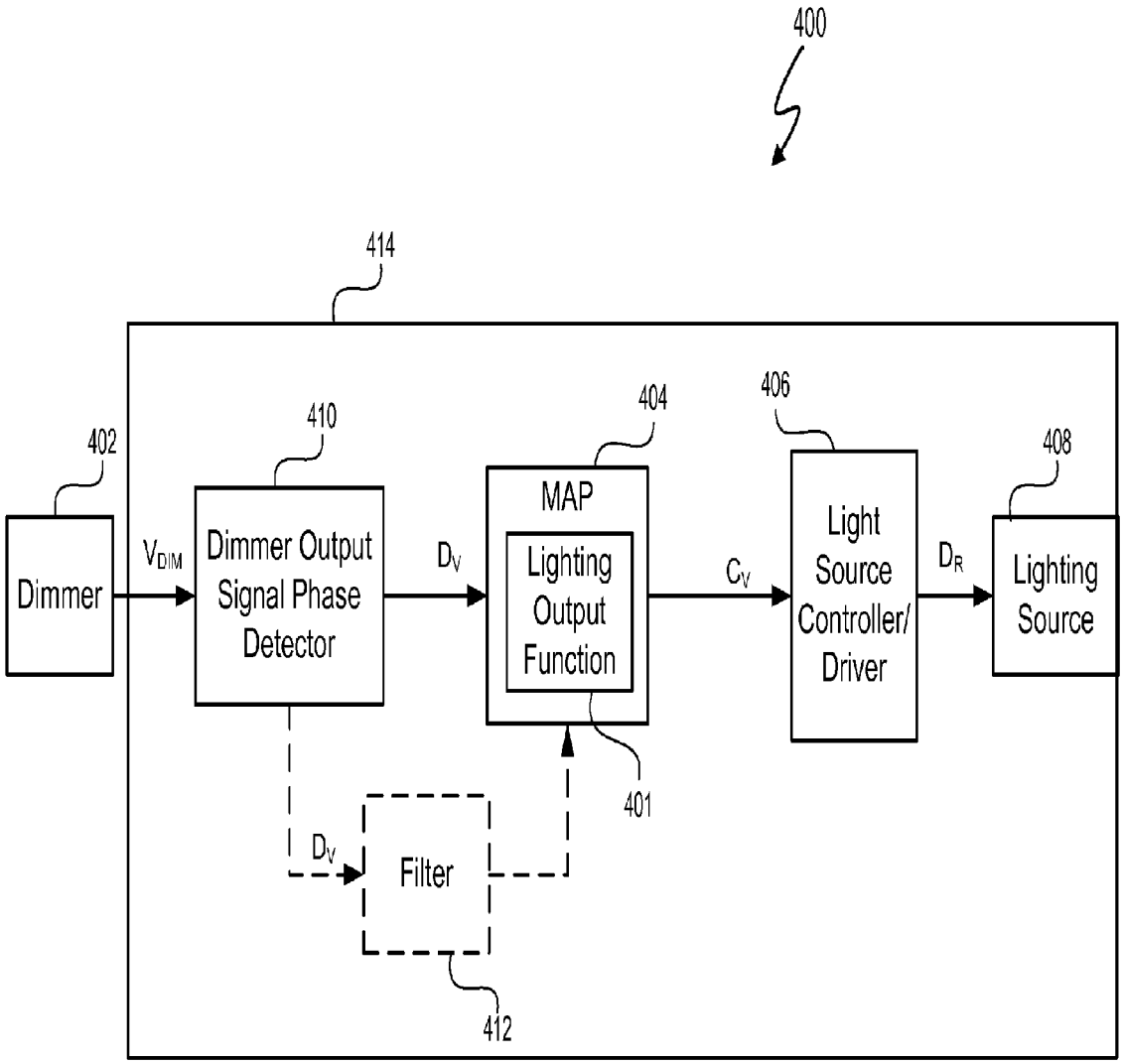
FIG. 4A depicts a lighting system that maps dimming levels of a lighting dimmer to light source control signals in accordance with a predetermined lighting output function.

FIG. 4A depicts a lighting system 400 that maps dimming levels of a lighting dimmer 402 to light source control signals in accordance with a predetermined lighting output function 401. In at least one embodiment, dimmer 402 is a conventional dimmer, such as dimmer 102 or dimmer 150. Dimmer 402 provides a dimmer output signal $V_{DIM}$. During a period of time, the dimmer output signal $V_{DIM}$ has a particular value $D_V$. For example, the dimmer output signal value $D_V$ is the phase angle of dimmer output signal $V_{DIM}$. The dimmer output signal value $D_V$ represents a dimming level. Without the map, the light source controller/driver 406 would map the dimmer output signal value $D_V$ to a dimming level corresponding to a measured light percentage. U.S. Provisional Application entitled "Ballast for Light Emitting Diode Light Sources" describes an exemplary light source controller/driver 406.

Figure 1A:
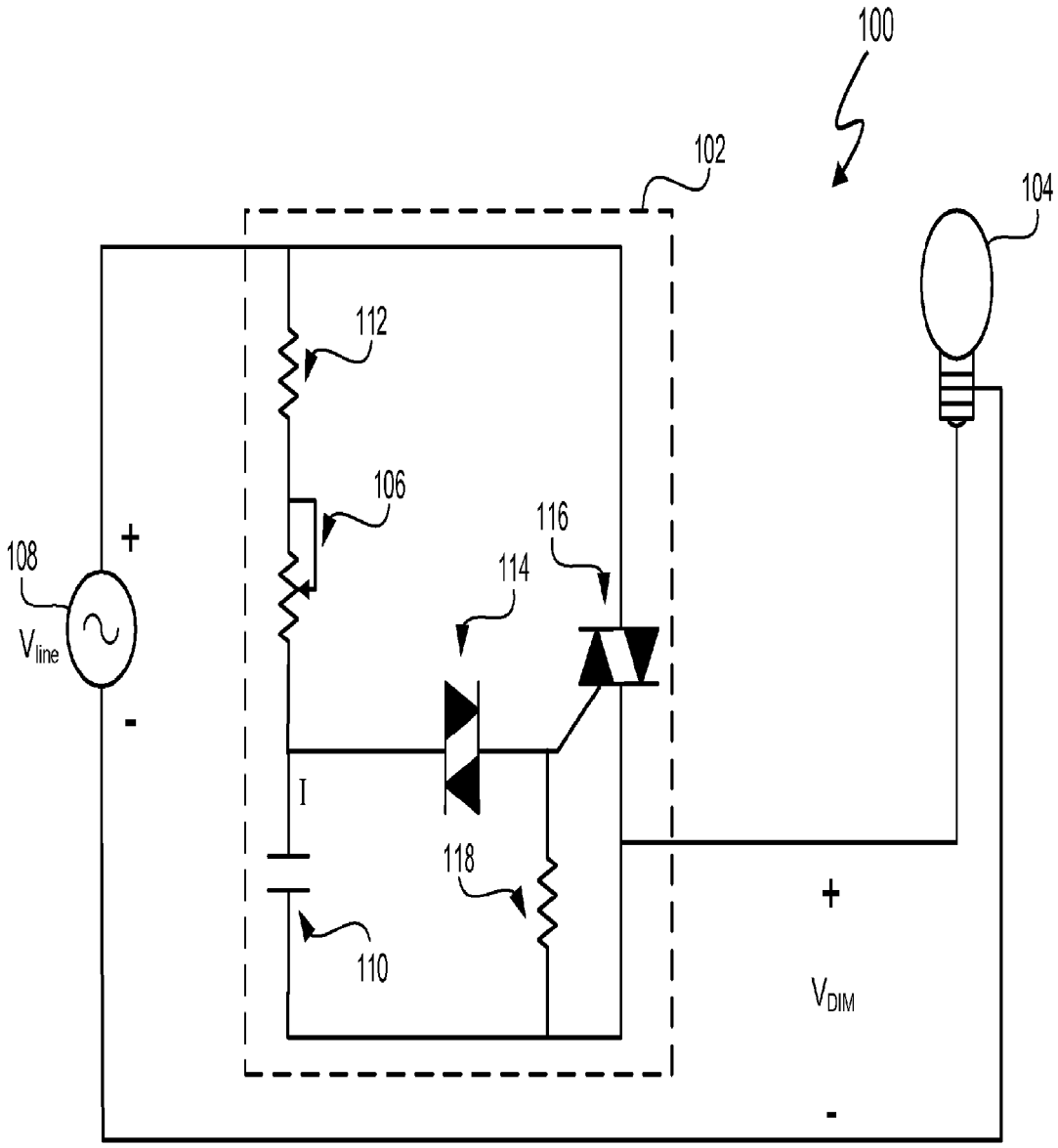
Figure 1A (prior art)
FIG. 1A (labeled prior art) depicts a lighting circuit with a conventional dimmer for dimming incandescent lamp.
Figure 1B:
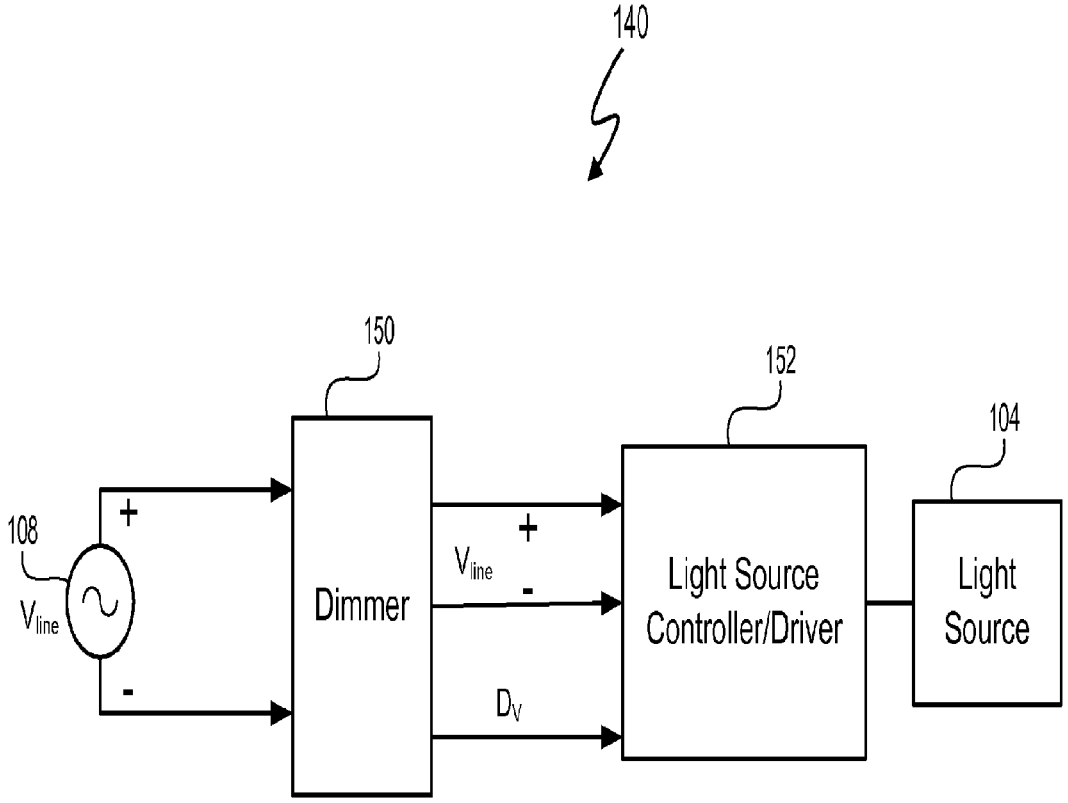
Figure 1B (prior art)
FIG. 1B (labeled prior art) depicts a lighting circuit with a conventional dimmer for dimming incandescent lamp.
Figure 2:
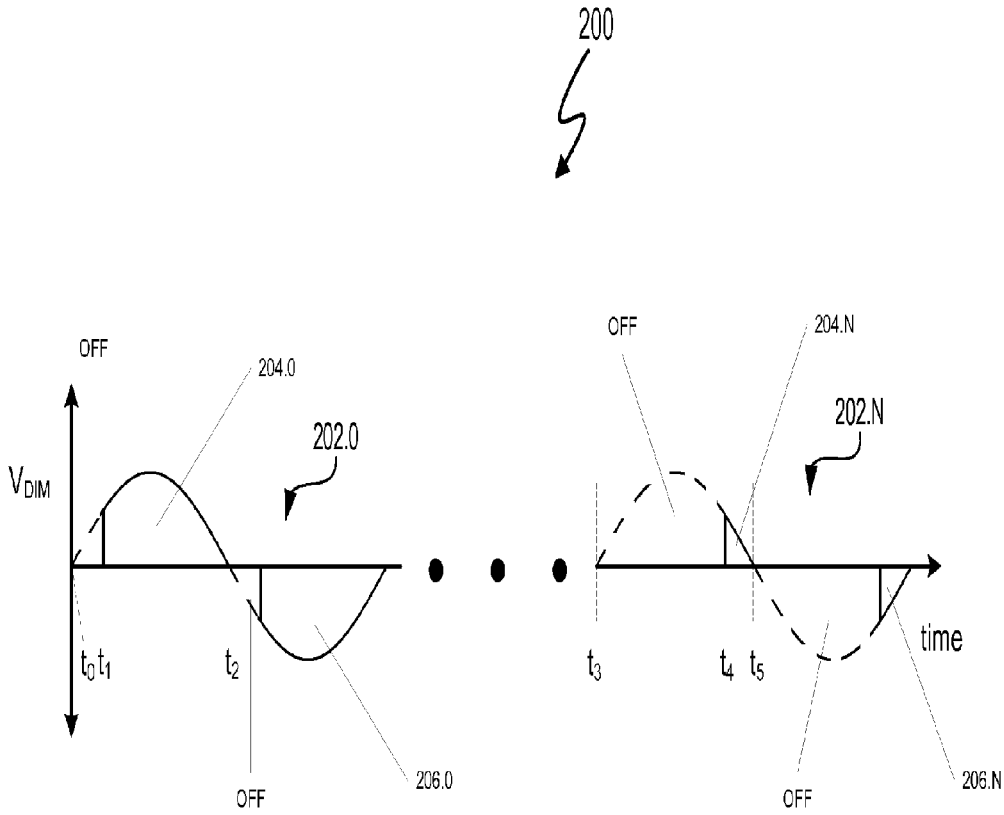
Figure 2 (prior art)
FIG. 2 (labeled prior art) depicts a phase angle modified dimmer output voltage waveform of a dimmer.

In at least one embodiment, a user selects a dimmer output signal value $D_V$ using a control (not shown), such as a slider, push button, or remote control, to select the dimming level. In at least one embodiment, the dimmer output signal $V_{DIM}$ is a periodic AC voltage. In at least one embodiment, in response to a dimming level selection, dimmer 402 chops the line voltage $V_{line}$ (FIG. 1) to modify a phase angle of the dimmer output signal $V_{DIM}$. The phase angle of the dimmer output signal $V_{DIM}$ corresponds to the selected dimming level. The dimmer output signal phase detector 410 detects the phase angle of dimmer output signal $V_{DIM}$. The dimmer output signal detector 410 generates a dimmer output signal value $D_V$ that corresponds to the dimming level represented by the phase angle of dimmer output signal $V_{DIM}$. In at least one embodiment, the dimmer output signal phase detector 410 includes a timer circuit that uses a clock signal $f_{clk}$ having a known frequency, and a comparator to compare the dimmer output signal $V_{DIM}$ to a neutral reference. Increasing the clock frequency increases the accuracy of phase detector 410. The dimmer output signal $V_{DIM}$ has a known frequency. The dimmer output signal phase detector 410 determines the phase angle of dimmer output signal $V_{DIM}$ by counting the number of cycles of clock signal $f_{clk}$ that occur until the chopping point (i.e. an edge of dimmer output signal $V_{DIM}$) of dimmer output signal $V_{DIM}$ is detected by the comparator.

Figure 4B:
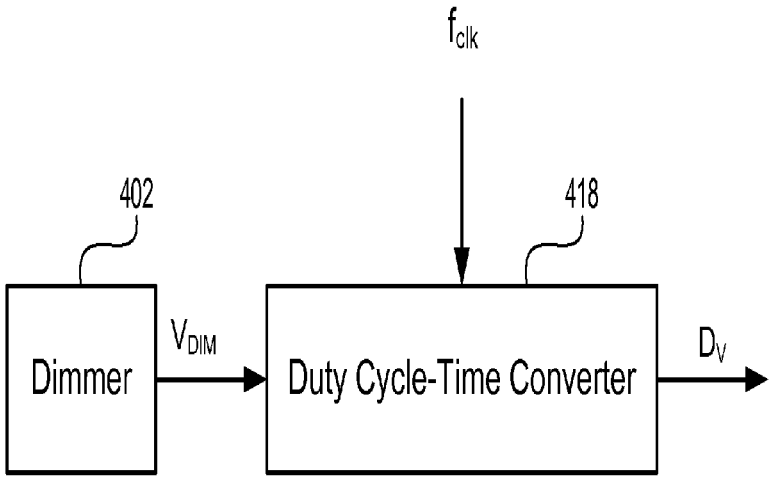
FIG. 4B depicts a duty cycle time converter that converts the dimmer input signal into digital data.

FIG. 4B depicts a duty cycle time converter 418 that converts the dimmer input signal $V_{DIM}$ into a digital dimmer output signal value $D_V$. The duty cycle time converter 418 is a substitution for dimmer output signal phase detector 410 in lighting system 400. The digital data of dimmer output signal value $D_V$ represents the duty cycles of dimmer output voltage $V_{DIM}$. The duty cycle time converter 418 determines the duty cycle of dimmer output signal $V_{DIM}$ by counting the number of cycles of clock signal $f_{clk}$ that occur until the chopping point of dimmer output signal $V_{DIM}$ is detected by the duty cycle time converter 418.

Figure 4C:
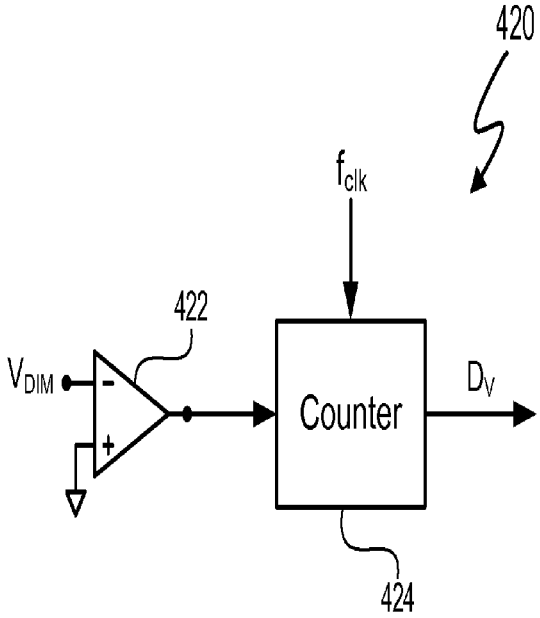
FIG. 4C depicts a duty cycle time converter.

FIG. 4C depicts a duty cycle time converter 420 that represents one embodiment of duty cycle time converter 418. Comparator 422 compares dimmer output voltage $V_{DIM}$ against a known reference. The reference is generally the cycle cross-over point voltage of dimmer output voltage $V_{DIM}$, such as a neutral potential of a household AC voltage. The counter 424 counts the number of cycles of clock signal $f_{clk}$ that occur until the comparator 422 indicates that the chopping point of dimmer output signal $V_{DIM}$ has been reached. Since the frequency of dimmer output signal $V_{DIM}$ and the frequency of clock signal $f_{clk}$ is known, the duty cycle can be determined from the count of cycles of clock signal $f_{clk}$ that occur until the comparator 422 indicates that the chopping point of dimmer output signal $V_{DIM}$. Likewise, the phase angle can also be determined by knowing the elapsed time from the beginning of a cycle of dimmer output signal $V_{DIM}$ until a chopping point of dimmer output signal $V_{DIM}$ is detected.

Figure 4D:
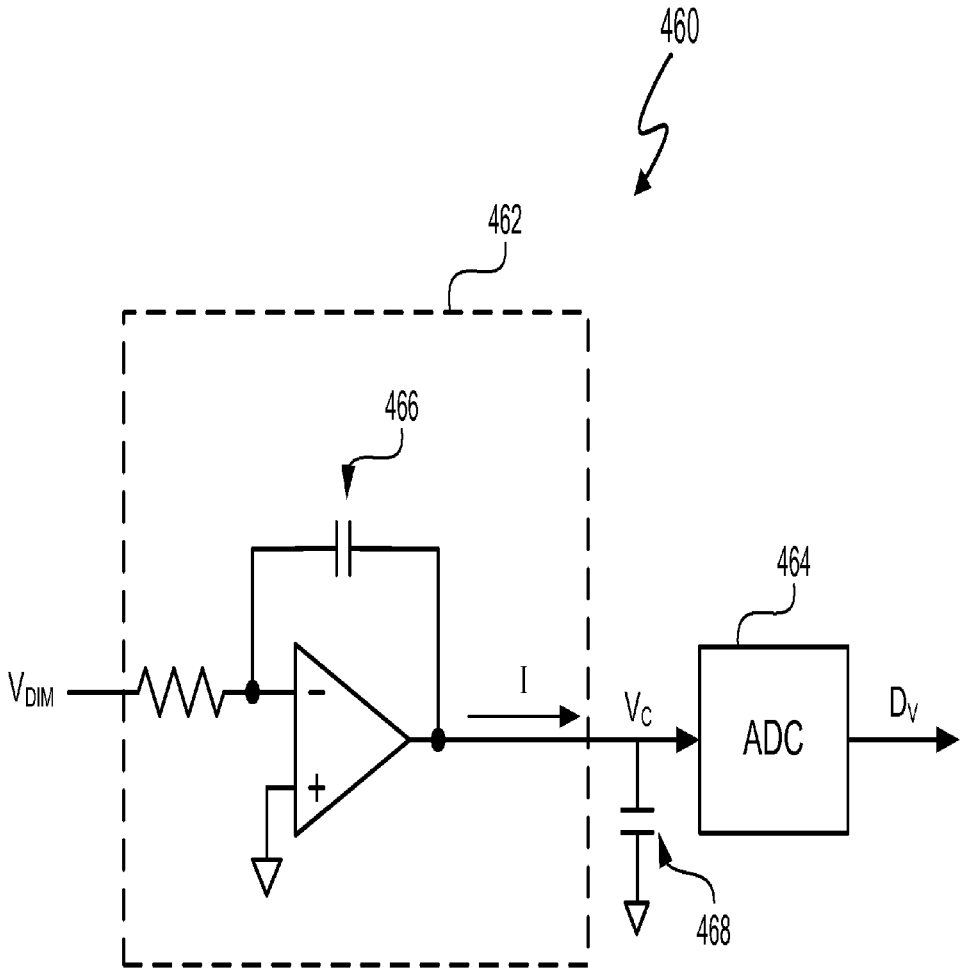
FIG. 4D depicts a duty cycle detector.

FIG. 4D depicts a duty cycle detector 460. The duty cycle detector 460 includes an analog integrator 462 that integrates dimmer output signal $V_{DIM}$ during each cycle (full or half cycle) of dimmer output signal $V_{DIM}$. The analog integrator 462 generates a current I corresponding to the duty cycle of dimmer output signal $V_{DIM}$ for each cycle of dimmer output signal $V_{DIM}$. The current provided by the analog integrator 462 charges a capacitor 468, and the voltage $V_C$ of the capacitor 468 can be determined by analog-to-digital converter (ADC) 464. The voltage $V_C$ directly corresponds to the duty cycle of dimmer output signal $V_{DIM}$. The analog integrator 462 can be reset after each cycle of dimmer output signal $V_{DIM}$ by discharging capacitors 462 and 468. The output of analog-to-digital converter 424 is digital data representing the duty cycle of dimmer output signal $V_{DIM}$.

In another embodiment, dimmer output signal $V_{DIM}$ can be chopped to generated both leading and trailing edges of dimmer voltage $V_{DIM}$. U.S. Pat. No. 6,713,974, entitled "Lamp Transformer For Use With An Electronic Dimmer And Method For Use Thereof For Reducing Acoustic Noise", inventors Patchornik and Barak, describes an exemplary system and method for leading and trailing edge dimmer voltage $V_{DIM}$ chopping and edge detection. U.S. Pat. No. 6,713,974 is incorporated herein by reference in its entirety.

In at least one embodiment, the mapping circuitry 404 receives the dimmer output signal value $D_V$. The mapping circuitry 404 includes lighting output function 401. The lighting output function 401 maps the dimmer output signal value $D_V$ to a control signal $C_V$. The light source controller/driver 406 generates a drive signal $D_R$ in response to the control signal $C_V$. In at least one embodiment, the control signal $C_V$ maps the dimmer output signal value to a different dimming level than the dimming level represented by the dimmer output signal value $D_V$. For example, in at least one embodiment, the control signal $C_V$ maps the dimmer output signal value $D_V$ to a human perceived lighting output levels in, for example, with an approximately linear relationship. The lighting output function 401 can also map the dimmer output signal value $D_V$ to other lighting functions. For example, the lighting output function 401 can map a particular dimmer output signal value $D_V$ to a timing signal that turns the lighting source 408 "off" after a predetermined amount of time if the dimmer output signal value $D_V$ does not change during the predetermined amount of time.

The lighting output function 401 can map dimming levels represented by values of a dimmer output signal to a virtually unlimited number of functions. For example, lighting output function 401 can map a low percentage dimming level, e.g. 90% dimming) to a light source flickering function that causes the light source 408 to randomly vary in intensity for a predetermined dimming range input. In at least one embodiment, the intensity of the light source results in a color temperature of no more than 2500 K. The light source controller/driver 406 can cause the lighting source 408 to flicker by providing random power oscillations to lighting source 408.

In one embodiment, values of the dimmer output signal dimmer output signal $V_{DIM}$ represent duty cycles having a range of approximately 95% to 10%. The lighting output function 402 maps dimmer output signal values to light source control signals using the lighting output function 401. The lighting output function maps the dimmer output signal values to the light source control signals to provide an intensity range of the light source 408 of greater than 95% to less than 5%.

The implementation of mapping circuitry 404 and the lighting output function 401 are a matter of design choice. For example, the lighting output function 401 can be predetermined and embodied in a memory. The memory can store the lighting output function 401 in a lookup table. For each dimmer output signal value $D_V$, the lookup table can include one or more corresponding control signal values $C_V$. Multiple control signal values $C_V$ can be used to generate multiple light source control signals $D_R$. When multiple mapping values are present, control signal $C_V$ is a vector of multiple mapping values. In at least one embodiment, the lighting output function 401 is implemented as an analog function generator that correlates dimmer output signal values with mapping values.

Figure 3:
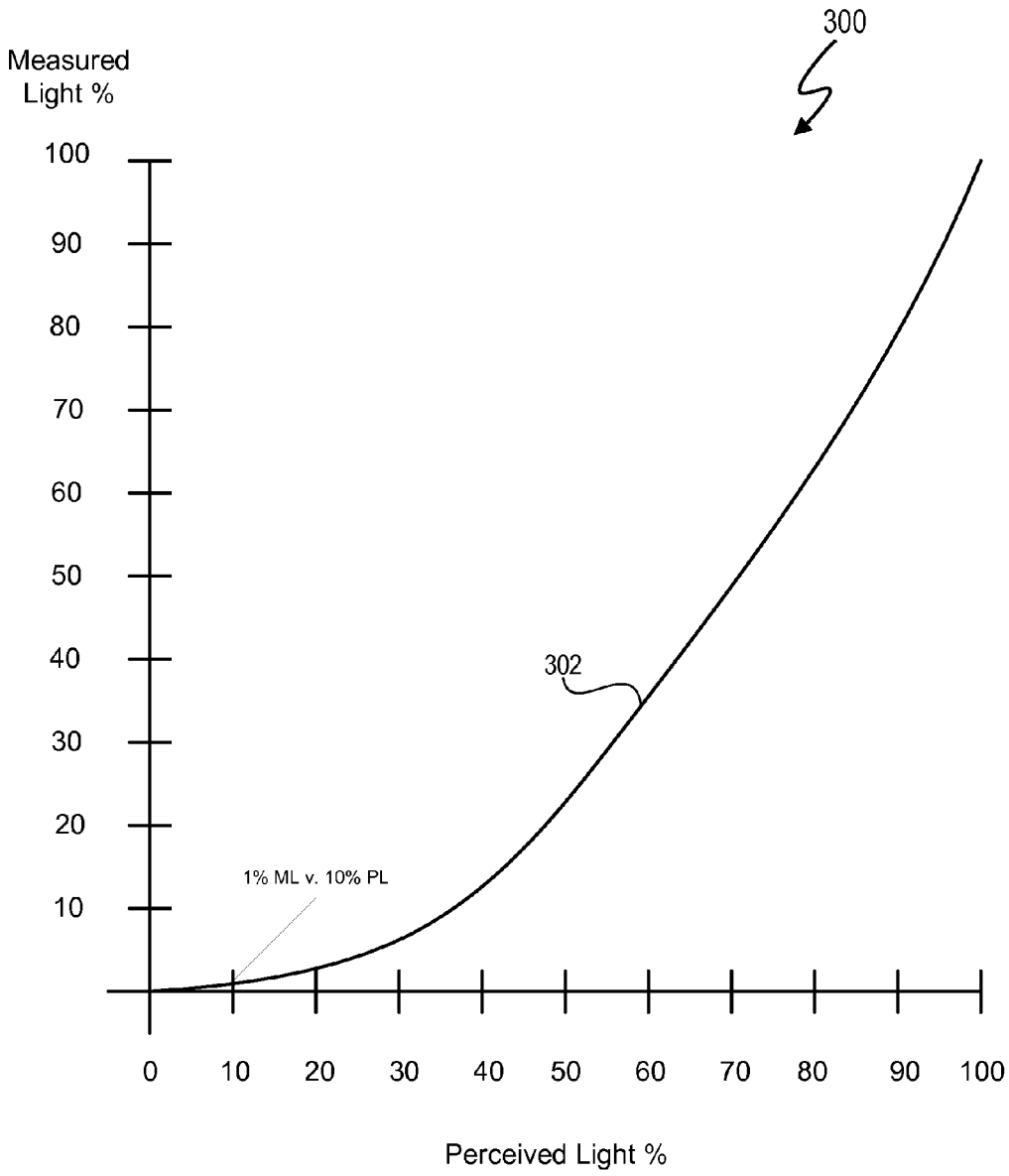
Figure 3 (prior art)
FIG. 3 (labeled prior art) depicts a measured light versus perceived light graph during dimming.
Figure 5:
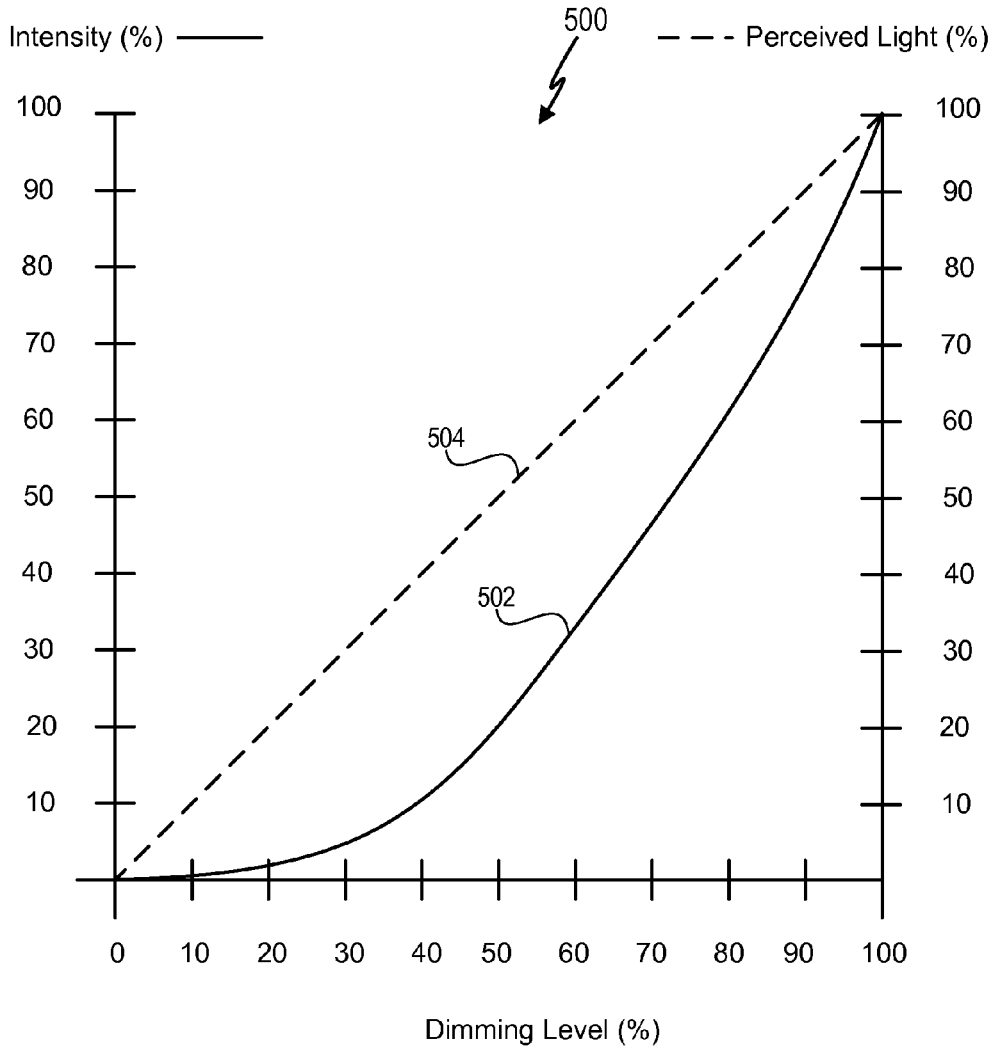
FIG. 5 depicts a graphical depiction of an exemplary lighting output function.

FIG. 5 depicts a graphical depiction 500 of an exemplary lighting output function 401. Referring back to the perceived light graph 300 (FIG. 3), conventionally as measured light percentage changed from 10% to 0%, the perceived light changed from about 32% to 0%. The exemplary lighting output function 401 maps the intensity percentage as indicated by the dimmer output signal value $D_V$ to a value that provides a linear, one-to-one relationship between perceived light percentages and dimming level percentages. Thus, when the dimming level is set to 50%, the perceived light percentage is also 50%, and so on. By providing a one-to-one linear relationship, the exemplary lighting output function 401 provides the dimmer 402 with greater sensitivity at high dimming level percentages.

In another embodiment, the lighting output function 401 includes a flickering function that maps a dimmer output signal value $D_V$ corresponding to a low light intensity, such as a 10% duty cycle, to control signals that cause lighting source 408 to flicker at a color temperature of no more than 2500 K. In at least one embodiment, flickering can be obtained by providing random power oscillations to lighting source 408.

The light source controller/driver 406 receives each control signal $C_V$ and converts the control signal $C_V$ into a control signal for each individual light source or each group of individual light sources in lighting source 408. The light source controller/driver 406 provides the raw DC voltage to lighting source 408 and controls the drive current(s) in lighting source 408. The control signals $D_R$ can, for example, provide pulse width modulation control signals to switches within lighting source 408. Filter components within lighting source 408 can filter the pulse width modulated control signals $D_R$ to provide a regulated drive current to each light source in lighting source 408. The value of the drive currents is controlled by the control signals $D_R$, and the control signals $D_R$ are determined by the mapping values from mapping circuitry 404.

A signal processing function can be applied in lighting system 400 to alter transition timing from a first light source intensity level to a second light source intensity level. The function can be applied before or after mapping with the lighting output function 401. In at least one embodiment, the signal processing function is embodied in a filter. In at least one embodiment, lighting system 400 includes a filter 412. When using filter 412, filter 412 processes the dimmer output signal value $D_V$ prior to passing the filtered dimmer output signal value $D_V$ to mapping circuitry 404. The dimmer output voltage $V_{DIM}$ can change abruptly, for example, when a switch on dimmer 402 is quickly transitioned from 90% dimming level to 0% dimming level. Additionally, the dimmer output voltage can contain unwanted perturbations caused by, for example, fluctuations in line voltage that supplies power to lighting system 400 through dimmer 402. Filter 412 can represent any function that changes the dimming levels indicated by the dimmer output signal value $D_V$. Filter 412 can be implemented with analog or digital components. In another embodiment, the filter filters the control signals $D_R$ to obtain the same results.

Figure 6:
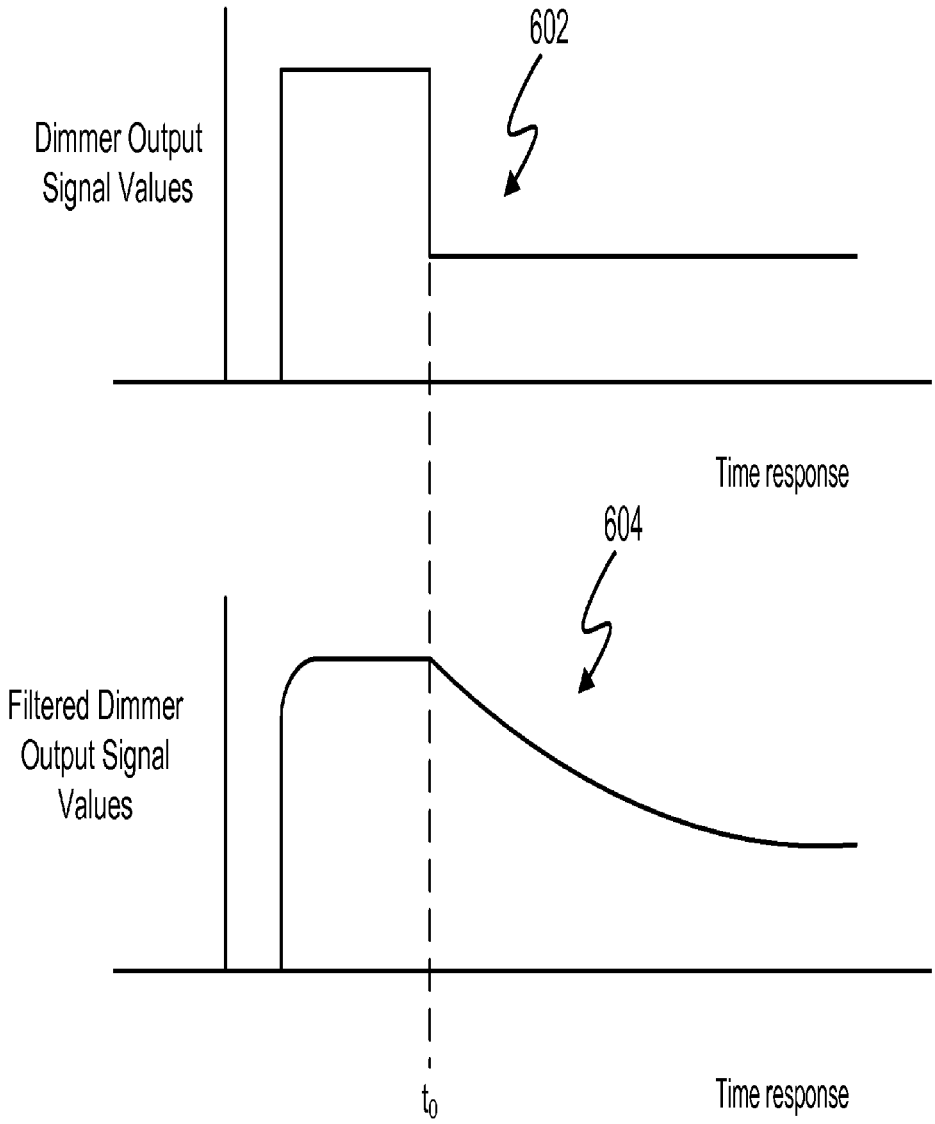
FIGS. 6 and 7 depict exemplary dimmer output signal values and filtered dimmer output signal values correlated in the time domain.

FIG. 6 depicts exemplary dimmer output signal values 602 and filtered dimmer output signal values 604 correlated in the time domain. The dimmer output signal values 602 abruptly change at time to. The filter 412 filters the dimmer output signal values 604 with a low pass averaging function to obtain a smooth dimming transition as indicated by the filtered dimmer output signal values 604. In at least one embodiment, abrupt changes from high dimming levels to low dimming levels are desirable. The filter 412 can also be configured to smoothly transition low to high dimming levels while allowing an abrupt or much faster transition from high to low dimming levels.

Figure 7:
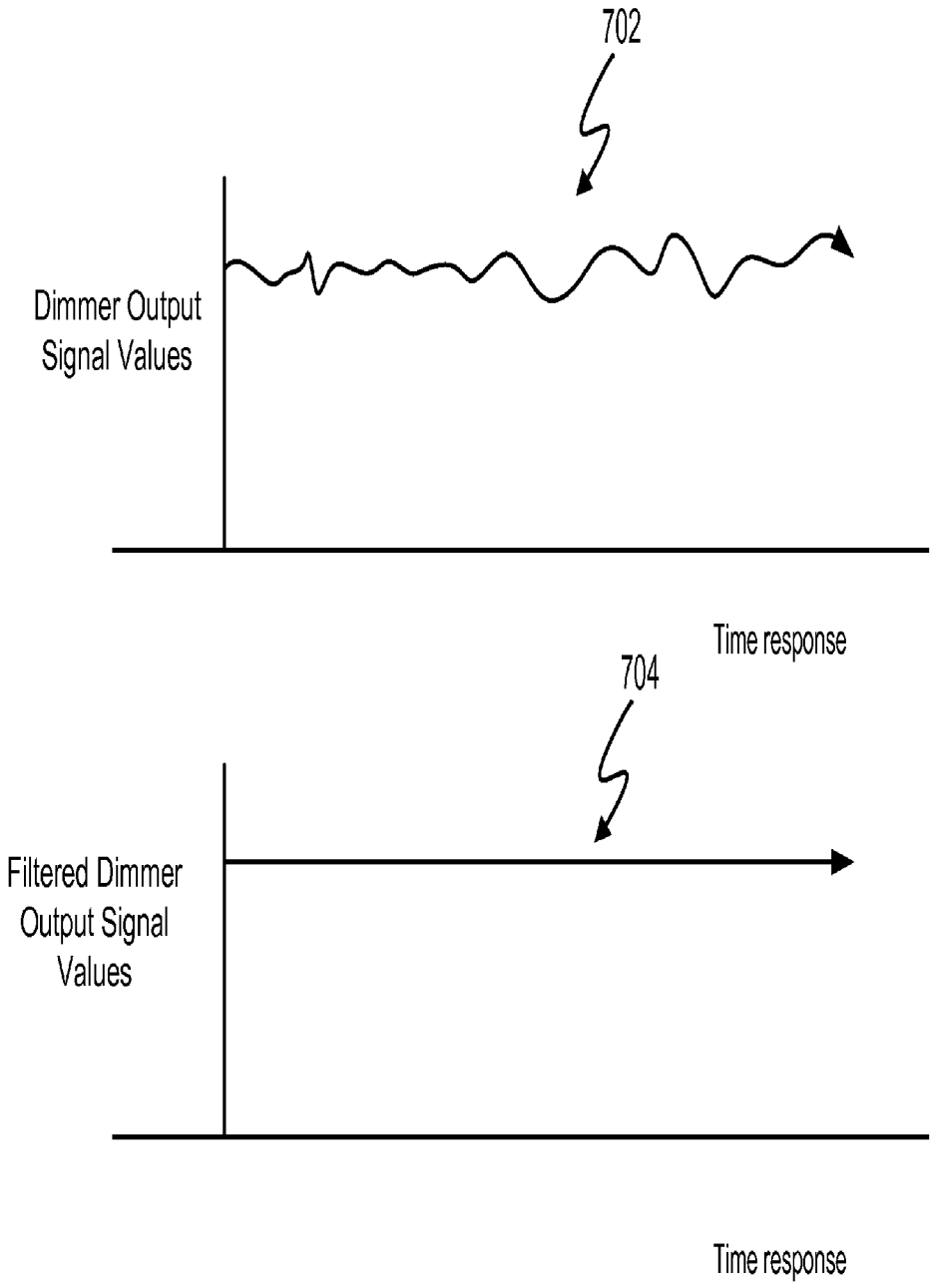

FIG. 7 depicts exemplary dimmer output signal values 702 and filtered dimmer output signal values 704 correlated in the time domain. The dimmer output signal values 702 contain perturbations (ripples) over time. The perturbations can be caused, for example, by fluctuations in line voltage. The filter 412 can use a low pass filter transfer function to smooth perturbations in the dimmer output signal values 702.

Lighting source 408 can include a single light source or a set of light sources. For example, lighting source 408 can include one more light emitting diodes or one or more gas discharge lamps. Each lighting source 408 can be controlled individually, collectively, or in groups in accordance with the control signal $C_V$ generated by mapping circuitry 404. The mapping circuitry 404, light source controller/driver 406, lighting source 408, dimmer output signal phase detector 410, and optional filter 412 can be collectively referred to as a lighting device. The lighting device 414 can include a housing to enclose mapping circuitry 404, light source controller/driver 406, lighting source 408, dimmer output signal phase detector 410, and optional filter 412. The housing can include terminals to connect to dimmer 402 and receive power from an alternating current (AC) voltage source. The components of lighting device 414 can also be packaged individually or in groups. In at least one embodiment, the mapping circuitry 404, light source controller/driver 406, dimmer output signal phase detector 410, and optional filter 412 are integrated in a single integrated circuit device. In another embodiment, integrated circuits and/or discrete components are used to build the mapping circuitry 404, light source controller/driver 406, dimmer output signal phase detector 410, and optional filter 412.

Although the present invention has been described in detail, it should be understood that various changes, substitutions and alterations can be made hereto without departing from the spirit and scope of the invention as defined by the appended claims.

What is claimed is:

1. A method for mapping dimming output signal values of a lighting dimmer using a predetermined lighting output function and operating a light source in response to mapped dimming output signal values, the method comprising:

receiving a dimmer output signal, wherein values of the dimmer output signal represent duty cycles having a range of within approximately 95% to 10% of a full duty cycle corresponding to an intensity range of light output from the light source of less than approximately 95% to 10% of a full intensity range of light output from the light source;

mapping the dimmer output signal values to light source control signals using the predetermined lighting output function, wherein the predetermined lighting output function maps the dimmer output signal values to the light source control signals to provide an intensity range of light output from the light source of greater than 95% to less than 5% of a full intensity range of light output from the light source; and operating a light source in accordance with the light source control signals.

2. The method of claim 1 wherein mapping the dimmer output signal values further comprises mapping the dimmer output signal values to light source control signals using the predetermined lighting output function, wherein the predetermined lighting output function maps the dimmer output signal values to the light source control signals to provide an intensity range of light output from the light source of greater than 95% to less than or equal to 2% of a full intensity range of light output from the light source.

3. A method for mapping dimming output signal values of a lighting dimmer using a predetermined lighting output function and driving a light source in response to mapped dimmer output signal values, the method comprising:

receiving a dimmer output signal, wherein values of the dimmer output signal represent one of multiple dimming levels;

applying a signal processing function to alter transition timing from a first light source intensity level to a second light source intensity level as indicated by a transition of the values of the dimmer output signal to a transition timing in accordance with the predetermined lighting output function;

mapping the dimmer output signal values to light source control signals using the predetermined lighting output function; and operating a light source in accordance with signals derived from the light source control signals.

4. The method of claim 3 wherein applying a signal processing function to alter transition timing from a first light source intensity level to a second light source intensity level comprises filtering at least a set of dimmer output signal values prior to mapping the dimmer output signal values.

5. The method of claim 3 wherein applying a signal processing function to alter transition timing from a first light source intensity level to a second light source intensity level comprises filtering at least a set of values of the light source control signals prior to generate the signals derived from the light source control signals.

6. The method of claim 3 wherein applying a signal processing function to alter transition timing from a first light source intensity level to a second light source intensity level further comprises:

low pass filtering the dimmer output signal values representing dimming levels below a predetermined threshold level to decrease a rate of change in the perceived light of the light source indicated dimmer output signal values.

7. The method of claim 6 wherein low pass filtering at least a set of dimmer output signal values prior to mapping the dimmer output signal values further comprises:

filtering the dimmer output signal values using a filter function that generates an approximately linear relationship between the dimmer output values and perceived light output of the light source.

8. The method of claim 3 further comprising:

detecting the dimming levels represented by the values of the dimmer output signal.

9. The method of claim 3 wherein the light source includes one or more lighting elements selected from the group consisting of: one or more light emitting diodes, one or more gas discharge lamps, and one or more incandescent lamps.

10. The method of claim 3 wherein the dimmer output signal value is a phase angle of the dimmer output voltage during a cycle of the dimmer output signal.

11. A lighting system comprising:

one or more input terminals to receive a dimmer output signal, wherein values of the dimmer output signal represent one of multiple dimming levels;

a filter to apply a signal processing function to alter transition timing from a first light source intensity level to a second light source intensity level as indicated by a transition of the values of the dimmer output signal to a transition timing in accordance with the predetermined lighting output function;

circuitry to map the dimmer output signal values to light source control signals using a predetermined lighting output function; and a light source driver to operate a light source in accordance with signals derived from the light source control signals.

12. The lighting system of claim 11 wherein the filter is configured to filter at least a set of dimmer output signal values prior to mapping the dimmer output signal values.

13. The lighting system of claim 11 wherein the filter is configured to filter at least a set of light source control signal values to generate the signals derived from the light source control signals.

14. A lighting system for mapping dimming output signal values of a lighting dimmer using a predetermined lighting output function and operating a light source in response to mapped dimming output signal values, the lighting system comprising:

one or more input terminals to receive a dimmer output signal, wherein values of the dimmer output signal represent duty cycles having a range of within approximately 95% to 10% of a full duty cycle corresponding to an intensity range of light output from the light source of less than approximately 95% to 10% of a full intensity range of light output from the light source;

circuitry to map the dimmer output signal values to light source control signals using the predetermined lighting output function, wherein the predetermined lighting output function maps the dimmer output signal values to the light source control signals to provide an intensity range of light output from the light source of greater than 90% to less than 5% of a full intensity range of light output from the light source; and;

a light source driver to operate a light source in accordance with the light source control signals.

15. The lighting system of claim 14 wherein circuitry to map the dimmer output signal values is further configured to map the dimmer output signal values to light source control signals using the predetermined lighting output function, wherein the predetermined lighting output function maps the dimmer output signal values to the light source control signals to provide an intensity range of light output from the light source of greater than 95% to less than or equal to 2% of a full intensity range of light output from the light source.

16. The lighting system of claim 14 further comprising:

a filter to filter at least a set of dimmer output signal values prior to mapping the dimmer output signal values.

* * * * *